United States Patent [19]

Huang et al.

[11] Patent Number: 4,682,652

[45] Date of Patent: Jul. 28, 1987

[54] PRODUCING HYDROCARBONS THROUGH SUCCESSIVELY PERFORATED INTERVALS OF A HORIZONTAL WELL BETWEEN TWO VERTICAL WELLS

[75] Inventors: Wann-Sheng Huang; Margaret A. Hight, both of Houston, Tex.

[73] Assignee: Texaco Inc., White Plains, N.Y.

[21] Appl. No.: 880,393

[22] Filed: Jun. 30, 1986

[51] Int. Cl.[4] ..... E21B 43/24

[52] U.S. Cl. ..... 166/263; 166/50; 166/272

[58] Field of Search ..... 166/50, 245, 263, 272

[56] References Cited

U.S. PATENT DOCUMENTS

| | | | |
|---|---|---|---|
| 3,259,186 | 7/1966 | Dietz | 166/263 |
| 3,581,822 | 6/1971 | Cornelius | 166/263 |
| 4,227,743 | 10/1980 | Ruzin | 166/272 X |
| 4,248,302 | 2/1981 | Churchman | 166/272 |
| 4,283,088 | 8/1981 | Tabakov | 299/2 |
| 4,303,126 | 12/1981 | Blevins | 166/50 X |
| 4,390,067 | 6/1983 | Willman | 166/50 X |
| 4,460,044 | 7/1984 | Porter | 166/50 X |
| 4,532,986 | 8/1985 | Mims et al. | 166/50 |
| 4,535,845 | 8/1985 | Brown et al. | 166/272 |

*Primary Examiner*—George A. Suchfield

*Attorney, Agent, or Firm*—Jack H. Park; Kenneth R. Priem; Harold J. Delhommer

[57] ABSTRACT

The invention uses two vertical wells and a horizotal well located within the underground formation extending between the two vertical wells. A thermal fluid is injected into the formation through the first vertical well. Hydrocarbons and other fluids are produced from the horizontal well through a first perforated interval located near the first vertical well. After depleting this area of the formation, the first perforated interval is closed off and the process is repeated for successively perforated intervals of the horizontal well, all of which are farther from the first vertical well than the preceding perforated intervals.

12 Claims, 2 Drawing Figures

PRODUCING HYDROCARBONS THROUGH SUCCESSIVELY PERFORATED INTERVALS OF A HORIZONTAL WELL BETWEEN TWO VERTICAL WELLS

BACKGROUND OF THE INVENTION

The invention process is concerned with the enhanced recovery of oil from underground formations. More particularly, the invention relates to a method for producing hydrocarbons through successively perforated intervals in a horizontal well lying between two vertical wells to efficiently sweep the portion of the formation bounded by the two vertical wells and the horizontal well.

Horizontal wells have been investigated and tested for oil recovery for quite some time. Although horizontal wells may in the future be proven economically successful to recover petroleum from many types of formations, at present, the use of horizontal wells is usually limited to formations containing highly viscous crude. It seems likely that horizontal wells will soon become a chief method of producing tar sand formations and other highly viscous oils which cannot be efficiently produced by conventional methods because of their high viscosity.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

U.S. Pat. No. 4,283,088 illustrates the use of a system of radial horizontal wells, optionally in conjunction with an inverted 9 spot having an unusually large number of injection wells. U.S. Pat. No. 4,390,067 illustrates a scheme of using horizontal and vertical wells together to form a pentagonal shaped pattern which is labeled a "5 spot" in the patent, although the art recognizes a different pattern as constituting a 5 spot.

U.S. Pat. No. 4,535,845 discloses a method for sweeping a portion of a formation with steam that is bounded by two vertical wells and a horizontal well. In this method, the vertical and horizontal wells are perforated throughout the hydrocarbon zone and steam is continuously injected through the first vertical well and the horizontal well. The process sweeps hydrocarbons through the formation and produces hydrocarbons only at the second vertical well.

SUMMARY OF THE INVENTION

The invention is a method of recovering hydrocarbons from a portion of an underground formation bounded by two vertical wells and a horizontal well. A thermal fluid, generally steam or hot water, is injected into the formation through one of the two vertical wells, and in some embodiments, the horizontal well. The formation is then produced through several successively perforated intervals in the horizontal well.

The invention uses two substantially vertical wells penetrating a hydrocarbon formation and a substantially horizontal well located within the underground formation extending between the two vertical wells. A thermal fluid is injected into the formation through the first vertical well. Hydrocarbons and other fluids are produced from the substantially horizontal well through a first perforated interval in the horizontal well which is located near the first vertical well. After depleting this area of the formation, the first perforated interval is closed off and fluids are produced from a second perforated interval of the horizontal well which is farther from the first vertical well than the first perforated interval. Generally, the second perforated interval will be adjacent to the first perforated interval but farther away from the first vertical well.

The process requires that the production of fluids through the horizontal well be moved to successively perforated intervals which are farther away from the first vertical well than the preceding production perforated intervals. After fluids have been produced through a perforated interval in the vicinity of the second vertical well, fluids are produced either simultaneously through the second vertical well and the horizontal well, or fluids are produced through the second vertical well.

Other embodiments of the invention are also disclosed. These include one embodiment wherein the thermal fluid is injected through the perforated interval of the horizontal well prior to producing fluids through that perforated interval. Another embodiment adds the step of allowing the thermal fluids to soak in the formation for a period of time prior to producing fluids. An additional variation on this process may be practiced by initially injecting a slug of thermal fluid through the first perforated interval of the horizontal well, allowing the reservoir to soak, and producing fluid through the first perforated interval and the first vertical well. A slug of thermal fluid is then injected at the first vertical well, the reservoir allowed to soak, and production taken at the first perforated interval and the first vertical well. These steps are repeated until the first region is depleted, and then repeated again for successively perforated intervals of the horizontal well.

DETAILED DESCRIPTION

Figure 1:
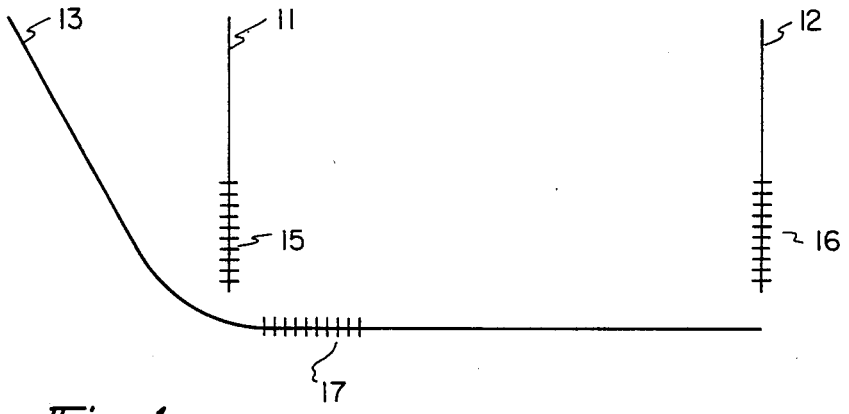
FIGS. 1 and 2 illustrate the practice of the invention at two successive time periods showing successively perforated intervals of the horizontal well.

Although they are more costly and difficult to drill, horizontal wells offer several advantages over vertical wells. One advantage is the increase in direct contact between the wellbore and the pay zone. The perforated interval per vertical well is limited to the pay zone thickness. But for a horizontal well, the perforated interval could be more than ten times that of a vertical wellbore. For example, a 400 foot horizontal well could be run in a 30 foot thick pay zone.

A second advantage of horizontal wells is the ability to complete several horizontal wells from a single location and cover a large drainage area. This is an important advantage when drilling in offshore, Arctic or environmentally sensitive areas where drill site preparation is a major expense. Thirdly, vertical drilling can be uneconomical in very thin pay zone areas. Properly placed horizontal wells can solve this problem. For certain thin formations with a bottom water table, horizontal wells could defer and reduce water coning by providing a low pressure area over a long distance rather than a single low pressure point as with vertical wells.

A fourth advantage is the ability to inject or produce fluids orthogonal to those from a vertical well. This provides the potential of improving the sweep efficiency of a flood, and therefore increasing recovery efficiency.

However, horizontal wells are significantly more expensive to drill than vertical wells. In addition, all existing hydrocarbon reservoirs have vertical wells which have already been drilled in the reservoirs. Thus, ways must be found to coordinate the use of horizontal wells with existing vertical well patterns.

The invention method provides a way of achieving horizontal well advantages by using a substantially horizontal well in conjunction with at least two substantially vertical wells for improving oil recovery efficiency. The invention requires that the substantially horizontal well extend from the general area of one vertical well to the general area of a second vertical well. Although this description and the drawings generally disclose a method wherein the horizontal well extends to the near vicinity of the vertical wells, the horizontal well need not extend the full distance between the two vertical wells. The invention can still be practiced with light oils even though the nearest horizontal well perforations are several hundred feet from the vertical well perforations. All that is required is a sufficient distance between the horizontal well perforations and the vertical well perforations so that the process steps may be carried out. In a formation containing highly viscous oil or tar sands, the horizontal well perforations would have to be much closer to the first vertical well than in the case of a hydrocarbon formation containing low gravity oils.

The horizontal wells should be drilled in the bottom third, most preferably the bottom fifth, of the hydrocarbon formation to take full advantage of horizontal well production properties. Generally, injection through the first vertical well will take place throughout the entire hydrocarbon interval, unless the characteristics of the formation suggest the advantages of a different method of completion, or unless the formation is unusually thick, such as in some tar formations.

The invention method has several different embodiments. In the first embodiment, the horizontal well is used chiefly for production and the first vertical well is employed as an injection well. In practicing this embodiment, a thermal fluid, such as steam or hot water, is injected into the formation through a first substantially vertical well. In some situations, other heated solvents or gases could be used as the thermal fluid. Fluids, hopefully including a good percentage of hydrocarbons, are produced from a first perforated interval in the horizontal well located in the vicinity of the first vertical well.

Injection and production is continued in this manner until this portion of the formation near the first vertical well and the first perforated interval are depleted from hydrocarbons, or until it is no longer economically feasible to continue the method in this part of the formation. At this time, production is stopped from the first perforated interval of the horizontal well by closing off these perforations in some manner, and producing fluids from a second perforated interval of the horizontal well which is farther from the first vertical well than the first perforated interval. It is possible to perforate most of the length of the horizontal well and close off undesired perforation intervals by the use of mechanical devices. But it is believed to be more efficient to create each successive horizontal well perforated interval by perforating the interval at the time it is needed. It may also be desirable to allow the thermal fluid to soak in the formation for a period of time ranging from about 1 day to about 20 days prior to producing fluids.

The above sequence of steps is repeated to move the production of fluids through the horizontal well to perforated intervals successively farther away from the first vertical well than the preceding production perforated intervals. After fluids have been produced through a perforated interval in the vicinity of the second substantially vertical well, fluids should also be produced through the second vertical well either (1) at the same time as fluids are produced through the horizontal well, or (2) after ceasing the production of fluids through the horizontal well.

This embodiment may be modified by injecting a thermal fluid through a perforated interval of the horizontal well prior to producing fluids through the perforated interval. This extra step may be particularly necessary in very tight oil and tar sand formations with a low steam injectivity. In such areas, it may not be possible to inject enough steam or hot water into the formation to practice the method until the formation in the immediate area of the well is sufficiently loosened or opened up by repeated huff-puff applications of a thermal fluid. The injection of a non-condensable gas, such as carbon dioxide or nitrogen, may also aid in loosening up such tight formations to permit the injection of a thermal fluid.

A second major embodiment of the invention is practiced by injecting a slug of a thermal fluid into the formation through the first perforated interval in the horizontal well in the vicinity of the first substantially vertical well. The thermal fluid is allowed to soak in the formation for about 1 day to about 20 days prior to producing fluids from the first perforated interval of the horizontal well. A slug of a thermal fluid is then injected into the formation through the first vertical well and allowed to soak for about 1 day to about 20 days prior to producing fluids simultaneously through the first perforated interval of the horizontal well and through the first vertical well. The first perforated interval is then closed off and the above steps are repeated for each successive perforated interval of the horizontal well, each succeeding perforated interval located farther from the first vertical well than the preceding perforated interval.

Once fluids have been produced through a perforated interval in the vicinity of the second vertical well, fluids can be produced through the second vertical well, either simultaneously with production through the horizontal well, or solely through the second vertical well. This method may be varied by producing fluids from the first vertical well simultaneously with the production of fluids from each of the perforated intervals of the horizontal well after injection through the perforated intervals of the horizontal well and soaking of the fluid in the formation.

The size of the slugs of injected thermal fluid may vary according to several factors, chief among these being the type of thermal fluid employed, the characteristics of the hydrocarbon formation, the oil contained therein, and the location of the wells relative to each other, as well as other factors. The size of the slugs may range from about 5000 barrels to about 30,000 barrels of steam, cold water equivalent.

A third variation of the invention can be practiced by injecting a slug of thermal fluid into the formation through the first perforated interval of the horizontal well located in the vicinity of the first vertical well, allowing the thermal fluid to soak in the formation for about 1 day to about 20 days, and producing fluids from the first vertical well. A slug of a thermal fluid is then injected into the formation through the first vertical well, allowed to soak in the formation for about 1 day to about 20 days, and fluids produced through the first perforated interval of the horizontal well. The above steps are repeated until the hydrocarbon formation in the vicinity of the first vertical well is depleted, or the process is no longer economical in this portion of the formation. The first perforated interval is then closed off and the steps are repeated for each successive perforated interval of the horizontal well. Once fluids are produced through the horizontal well in the vicinity of the second vertical well, fluids may then be produced through the second vertical well.

Figure 2:
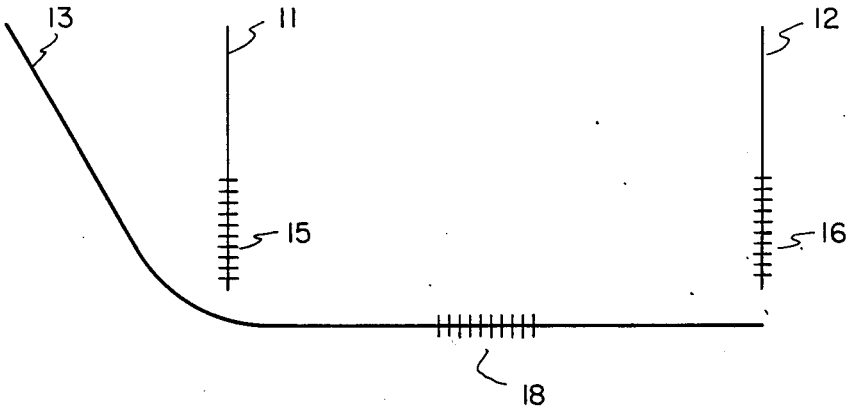

FIGS. 1 and 2 illustrate the basic step sequence of the invention wherein the horizontal well located between the two vertical wells is progessively perforated along its length between the two vertical wells to more effectively utilize the injected steam or hot water. In these figures, the first vertical well 11 is perforated through interval 15, the second vertical well 12 is perforated at interval 16, and the horizontal well 13 is perforated at the first perforation interval 17 in FIG. 1, and later, at the second perforated interval 18 of the horizontal well 13.

Because of the well known tendency of steam to rise in a formation and create steam override zones, the use of this invention method with its successively perforated horizontal well intervals will substantially reduce steam override zones. The injection of a thermal fluid such as steam according to this invention will sequentially sweep the reservoir from the first vertical well to the second vertical well without leaving steam override zones. The injection and production of steam at the horizontal well will heat up the bottom portion of the reservoir and improve fluid mobility in this region. Injecting steam through the first vertical well will tend to sweep the top portion of the reservoir because of the gravity nature of steam. As a result of combining injections at the first vertical well, and in some embodiments at the horizontal well, and producing at the horizontal well, the entire reservoir will be swept more efficiently.

In many hydrocarbon formations, there are a substantial number of existing vertical wells. To practice the invention, it is only necessary to drill a horizontal well between pairs of vertical wells. The first and second vertical wells described herein could represent an injector and a producer pair, or two vertical injection wells in a 5-spot, 7-spot, 9-spot or any other pattern configuration. Although the invention method may be practiced in most hydrocarbon reservoirs, production economics resulting from the currently high cost of horizontal wells will probably limit its use to thermal recovery in heavy oil or tar sand reservoirs for the next few years.

The invention requires that the perforated intervals of the horizontal well be closed off before moving onto succeeding horizontal well perforated intervals. This may be done in several ways. One method is to use a sliding sleeve arrangement inside the casing to close off the perforations. A second method is to fill in the borehole with concrete where it is desired to close off the perforations, and recomplete the well by drilling through the concrete. A third method is to inject some chemical compound through the perforations to close off the formation near those perforations.

Horizontal wells must extend from the surface and run a substantially horizontal distance within the hydrocarbon formation. Normally, the horizontal well is spudded into the substrate in such a manner as to approach the overburden layer either vertically, or at an angle. Thereafter, as the wellbore enters and penetrates the hydrocarbon formation, it is diverted into a substantially horizontal direction. Preferably, the wellbore will be urged in a direction so that it will run concurrently with the productive hydrocarbon layer. Recent technological advances have even made it possible to drill a horizontal well through and from a previously existing vertical well. Thus, the term horizontal well as used herein refers to any well which runs in a substantially horizontal direction within a hydrocarbon formation, regardless of the type or origin of the horizontal well.

The diameter and length of the horizontal wells and their perforation intervals are not critical, except that such factors will affect the well spacing and the economics of the process. The length of each perforation interval could be one-quarter of the distance between the two vertical wells or shorter. Perforation size will be a function of factors such as flow rate, temperatures and pressures employed in a given operation. Such decisions should be determined by conventional drilling criteria, the characteristics of the specific formation, the economics of a given situation, and the well known art of drilling horizontal wells.

Many variations of the method of this invention will be apparent to those skilled in the art from the foregoing discussion and examples. Variations can be made without departing from the scope and spirit of the following claims.

What is claimed is:

1. A method for producing hydrocarbons from a portion of an underground formation bounded by at least two substantially vertical wells and at least one substantially horizontal well, comprising:

injecting a thermal fluid into the formation through a first substantially vertical well;

producing fluids from a substantially horizontal well located within the underground formation, said horizontal well extending from an area near the first vertical well to the vicinity of a second substantially vertical well penetrating the formation, said horizontal well produced fluids only being produced from a first perforated interval in the horizontal well in the vicinity of the first vertical well;

ceasing production from the first perforated interval of the horizontal well and producing fluids from a second perforated interval of the horizontal well which is farther from the first vertical well than the first perforated interval;

continuing to move the production of fluids through the horizontal well to perforated intervals successively farther away from the first vertical well than the preceding production perforated intervals;

after fluids have been produced through a perforated interval in the vicinity of the second vertical well, producing fluids through the second vertical well.

2. The method of claim 1, further comprising ceasing the production of fluids through the horizontal well when fluids are produced through the second vertical well.

3. The method of claim 1, further comprising injecting a thermal fluid through a perforated interval of the horizontal well prior to producing fluids through the perforated interval.

4. The method of claim 3, further comprising allowing the thermal fluid to soak in the formation for about 1 day to about 20 days prior to producing fluids.

5. The method of claim 1, wherein the injected thermal fluid is steam.

6. The method of claim 1, wherein the injected thermal fluid is hot water.

7. A method for producing hydrocarbons from a portion of an underground formation bounded by at least two substantially vertical wells and at least one substantially horizontal well, comprising:

(a) injecting a slug of a thermal fluid into the formation through a first perforated interval in a substantially horizontal well, said horizontal well extending from an area near a first substantially vertical well penetrating the formation to the vicinity of a second substantially vertical well penetrating the formation, said first perforated interval of the horizontal well located in the vicinity of the first vertical well;

(b) allowing the thermal fluid to soak in the formation for about 1 day to about 20 days;

(c) producing fluids from the first perforated interval in the horizontal well;

(d) injecting a slug of a thermal fluid into the formation through the first vertical well;

(e) allowing the thermal fluid to soak in the formation from about 1 day to about 20 days;

(f) producing fluids through the first perforated interval in the horizontal well and through the first vertical well;

(g) repeating steps (a) through (f) until the hydrocarbon formation in the vicinity of the first vertical well is depleted;

(h) closing off the first perforated interval;

(i) repeating steps (a) through (h) for successive perforated intervals of the horizontal well, each succeeding perforated interval located farther from the first vertical well than the preceding perforated interval;

(j) after fluids have been produced through a perforated interval in the vicinity of the second vertical well, producing fluids through the second vertical well.

8. The method of claim 7, further comprising ceasing the production of fluids through the horizontal well when fluids are produced through the second vertical well.

9. The method of claim 7, further comprising producing fluids from the first vertical well in step (c) in addition to producing fluids from the perforated intervals of the horizontal well after the injection of a slug of thermal fluid into the formation and soaking of the thermal fluid in the formation.

10. The method of claim 7, wherein the injected thermal fluid is steam.

11. The method of claim 7, wherein the injected thermal fluid is hot water.

12. A method for producing hydrocarbons from a portion of an underground formation bounded by at least two substantially vertical wells and at least one substantially horizontal well, comprising:

(a) injecting a slug of a thermal fluid into the formation through a first perforated interval in a substantially horizontal well, said horizontal well extending from an area near a first substantially vertical well penetrating the formation to the vicinity of a second substantially vertical well penetrating the formation, said first perforated interval of the horizontal well located in the vicinity of the first vertical well;

(b) allowing the thermal fluid to soak in the formation for about 1 day to about 20 days;

(c) producing fluids from the first vertical wells;

(d) injecting a slug of a thermal fluid into the formation through the first vertical well;

(e) allowing the thermal fluid to soak in the formation from about 1 day to about 20 days;

(f) producing fluids through the first perforated interval in the horizontal well;

(g) repeating steps (a) through (f) until the hydrocarbon formation in the vicinity of the first vertical well is depleted;

(h) closing off the first perforated interval;

(i) repeating steps (a) through (h) for successive perforated intervals of the horizontal well, each succeeding perforated interval located farther from the first vertical well than the preceding perforated interval;

(j) after fluids have been produced through a perforated interval in the vicinity of the second vertical well, producing fluids through the second vertical well.

* * * * *